US009484677B2

(12) United States Patent
Guo et al.

(10) Patent No.: US 9,484,677 B2
(45) Date of Patent: Nov. 1, 2016

(54) ELECTRICAL CONNECTOR HAVING IMPROVED GROUNDING MEMBER

(71) Applicant: FOXCONN INTERCONNECT TECHNOLOGY LIMITED, Grand Cayman (KY)

(72) Inventors: Bin Guo, Kunshan (CN); Chun-Ming Yu, Kunshan (CN); Bing-Bo Hu, Kunshan (CN); Guo-Hua Zhang, Kunshan (CN); Qi-Sheng Zheng, Kunshan (CN); Yu-Long Mao, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/880,123

(22) Filed: Oct. 9, 2015

(65) Prior Publication Data

US 2016/0104975 A1 Apr. 14, 2016

(30) Foreign Application Priority Data

Oct. 9, 2014 (CN) ..... 2014 2 0580138 U

(51) Int. Cl.
*H01R 13/6581* (2011.01)
*H01R 13/658* (2011.01)
*H01R 13/6585* (2011.01)

(52) U.S. Cl.
CPC ..... *H01R 13/6585* (2013.01)

(58) Field of Classification Search
CPC ..... H01R 13/6581; H01R 13/658
USPC ..... 439/607.28, 607.35–607.4, 607.55, 439/607.56
See application file for complete search history.

(56) References Cited

U.S. PATENT DOCUMENTS 6,042,398 A * 3/2000 Wu ..... H01R 13/655 439/101
6,319,026 B1 * 11/2001 Chen ..... H01R 13/65802 439/108
6,655,992 B1 * 12/2003 Ko ..... H01R 12/775 439/497
2006/0264104 A1 * 11/2006 Olson ..... H01R 13/41 439/607.28

FOREIGN PATENT DOCUMENTS

TW M496857 3/2015

* cited by examiner

*Primary Examiner* — Gary Paumen
(74) *Attorney, Agent, or Firm* — Wei Te Chung; Ming Chieh Chang

(57) ABSTRACT

An electrical receptacle connector includes a terminal module assembly and a grounding collar thereon. The terminal module assembly includes the front mating tongue, the rear body, and the step structure therebetween, and the corresponding contacts. The contacts are secured to the body with contacting sections exposed upon the mating tongue. The grounding collar includes the grounding regions located on two opposite upper and lower surfaces of the step structure. The front edge area of the grounding region adjacent to the front edge area, forms a notch so as to leave a space to allow the spring finger of the corresponding interior grounding plate of the plug connector to first slide upon the step structure and successively contact the grounding region of the grounding collar of the receptacle connector.

13 Claims, 14 Drawing Sheets

ELECTRICAL CONNECTOR HAVING IMPROVED GROUNDING MEMBER

BACKGROUND OF THE INVENTION

1. Field of the Invention

The present invention relates generally to an electrical connector, more particularly to the connector with an improved internal grounding collar.

2. Description of Related Arts

USB (Universal Serial Bus) committee announced the Type C connector specification on Aug. 11, 2014 wherein the Type C plug connector may be mated with the corresponding Type C receptacle connector in a flippable manner without the specific orientation As shown in TW M496857, one feature of the Type C connector assembly is to provide the internal grounding collar around the root of the mating tongue of the receptacle connector and the interior grounding spring fingers in the receiving cavity of the plug connector so as to form an internal grounding path during mating. Anyhow, in some conditions if the manufacturing tolerance is out of control, the spring fingers may not be properly slide upon the grounding collar but being crashed during mating.

An improved wire spacer in a cable connector assembly is desired.

SUMMARY OF THE INVENTION

An object of the present invention is to provide an improved structure of the internal grounding collar of the receptacle connector so as to make sure of no crash thereof during mating with the plug connector.

To achieve the above-mentioned object, an electrical receptacle connector includes a terminal module assembly and a grounding collar thereon. The terminal module assembly includes the front mating tongue, the rear body, and the step structure therebetween, and the corresponding contacts. The contacts are secured to the body with contacting sections exposed upon the mating tongue. The grounding collar includes the grounding regions located on two opposite upper and lower surfaces of the step structure. The front edge area of the grounding region adjacent to the front edge area, forms a notch so as to leave a space to allow the spring finger of the corresponding interior grounding plate of the plug connector to first slide upon the step structure and successively contact the grounding region of the grounding collar of the receptacle connector. Compared with the traditional design, the notch may prevent the grounding region from improperly colliding against the spring finger of the plug connector due to any out-of-range manufacturing tolerance of either the receptacle connector and the plug connector.

DETAILED DESCRIPTION OF THE PREFERRED EMBODIMENT

Figure 1:
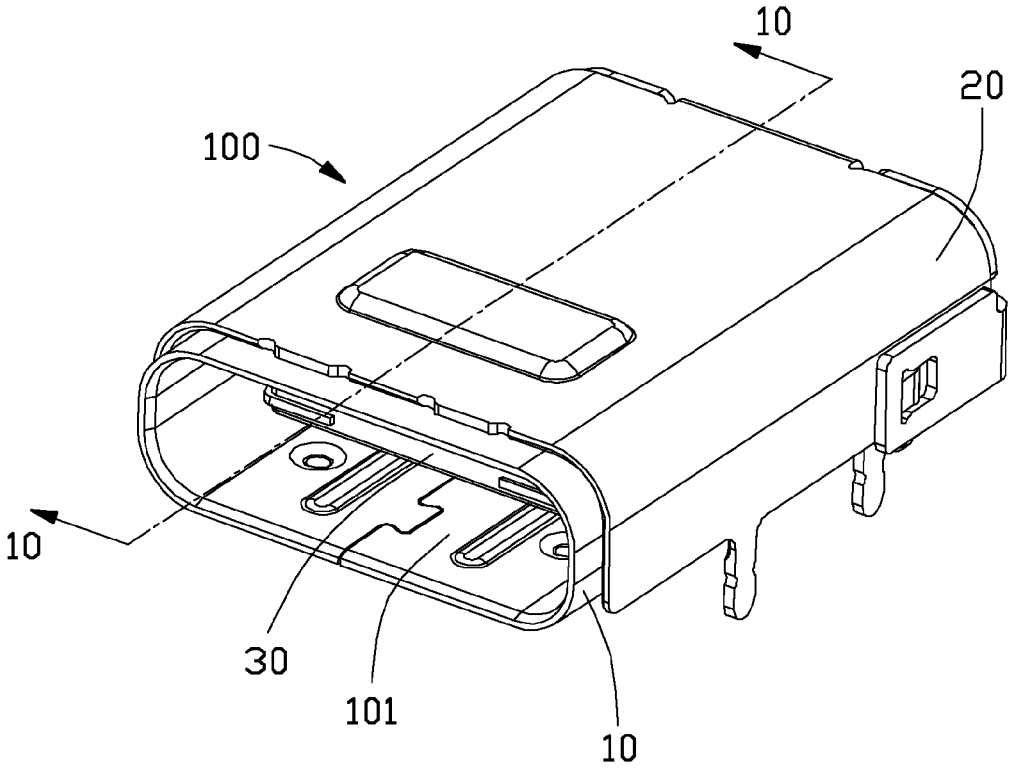
FIG. 1 is a perspective view of a receptacle connector in accordance with the present invention.
Figure 2:
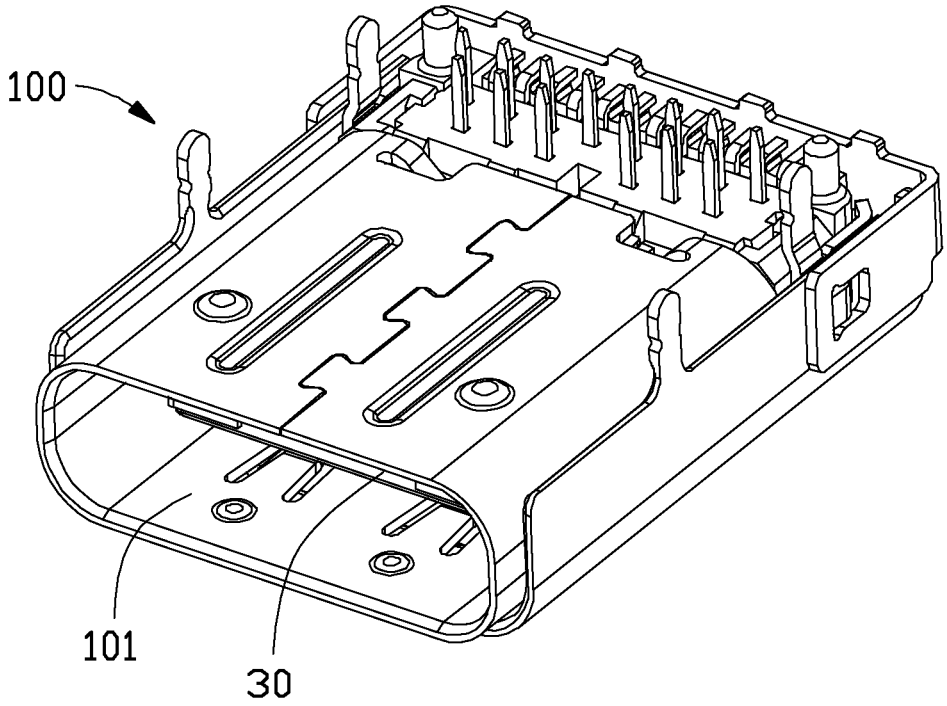
FIG. 2 is another perspective view of the receptacle connector in FIG. 1.
Figure 3:
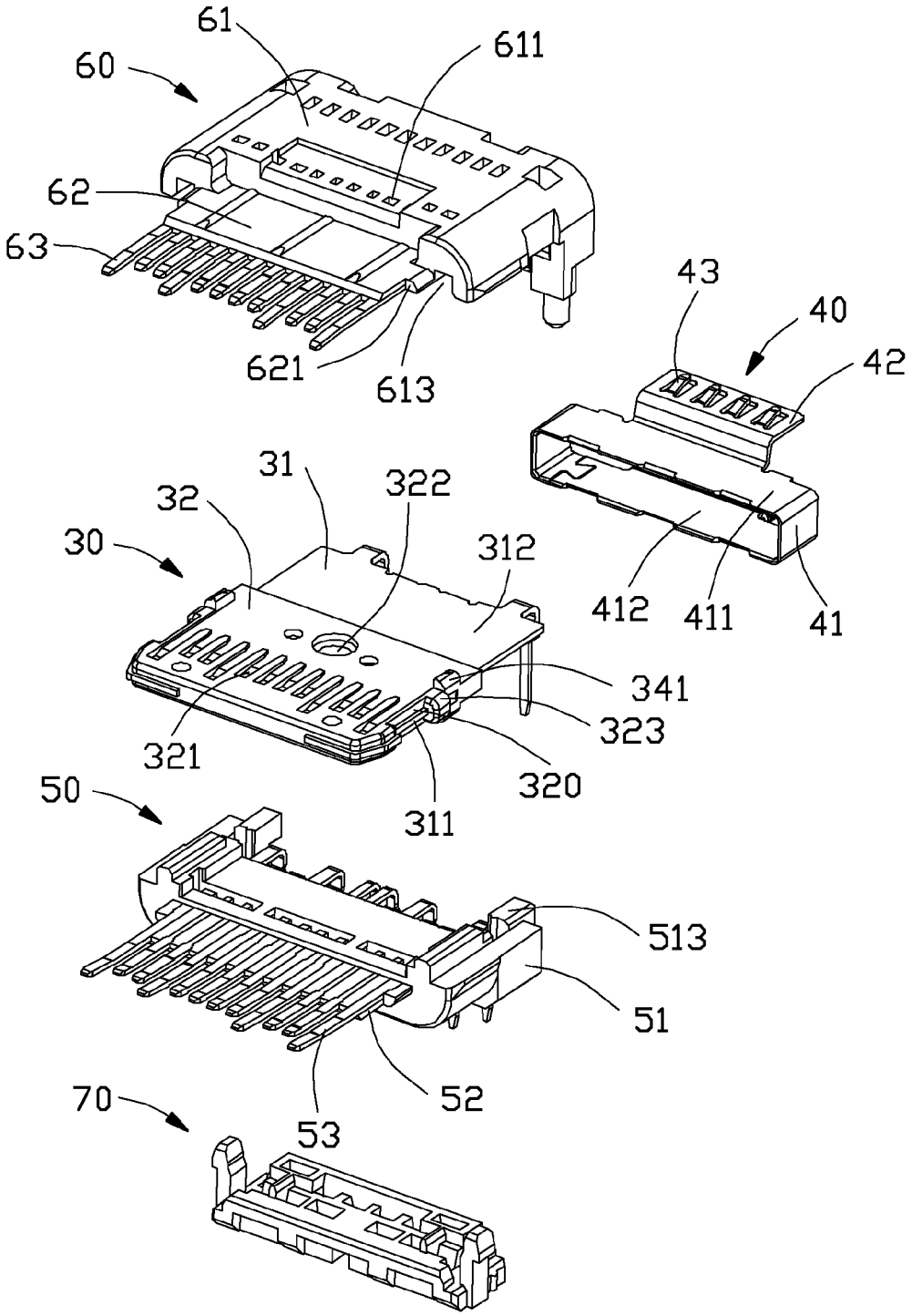
FIG. 3 is an exploded perspective view of the terminal module assembly and the grounding collar of the receptacle connector of FIG. 1.
Figure 4:
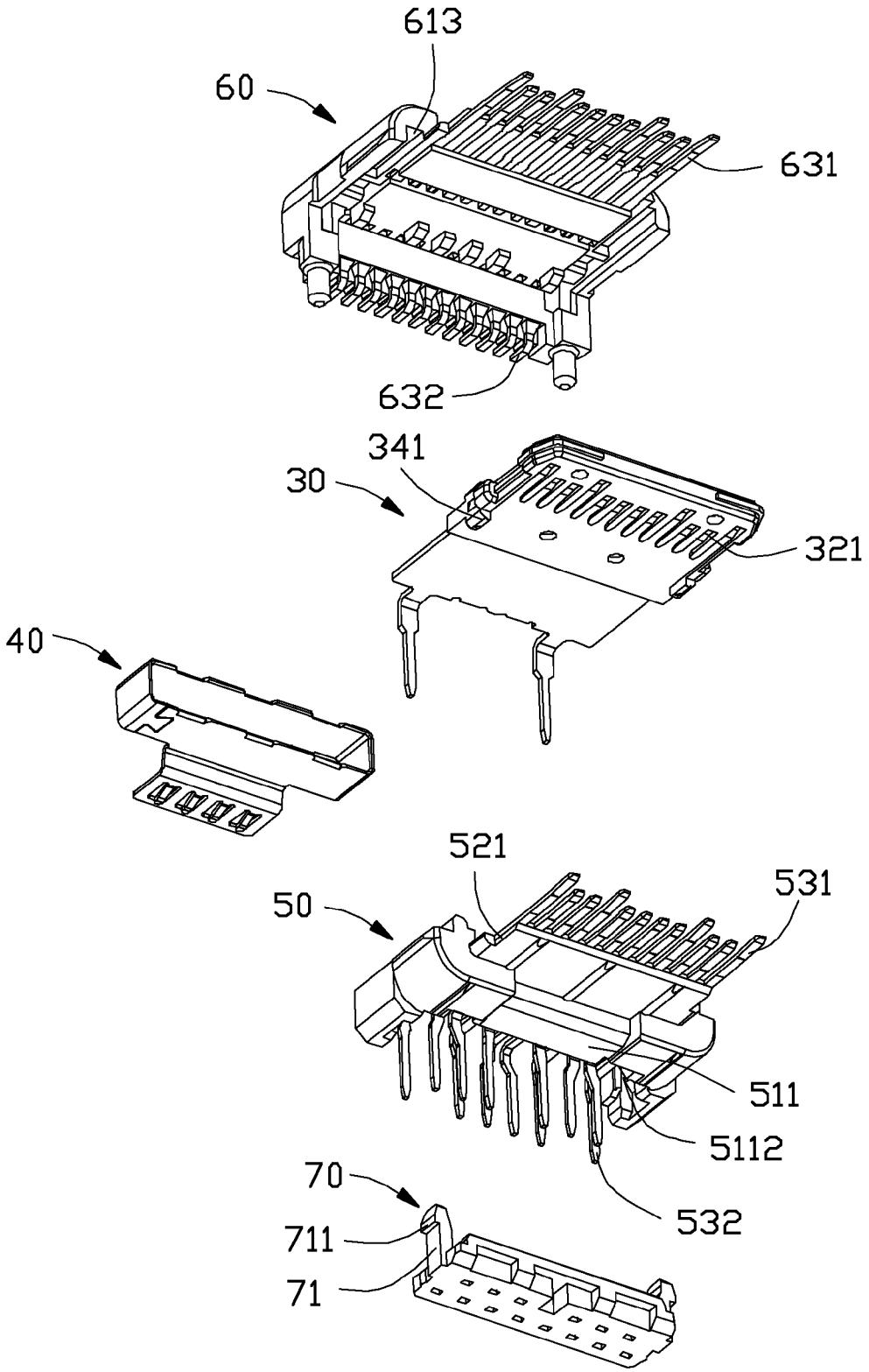
FIG. 4 is another exploded perspective view of the terminal module assembly and the grounding collar of the receptacle connector of FIG. 1.
Figure 5:
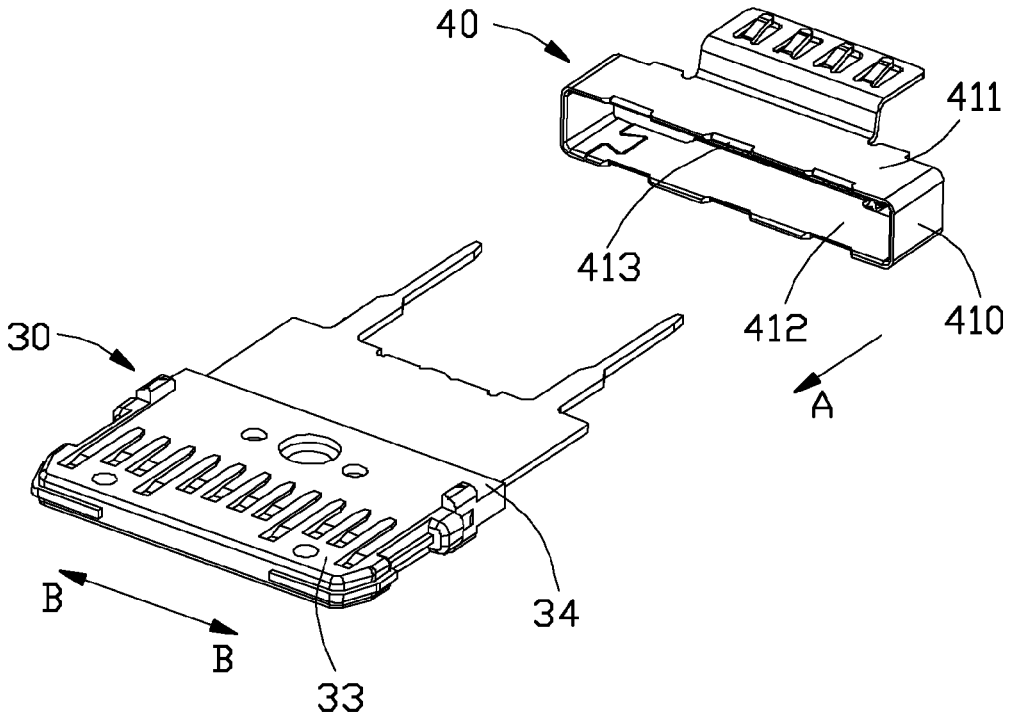
FIG. 5 is a partially exploded perspective view of the tongue plate and the grounding collar of the receptacle connector of FIG. 1.
Figure 6:
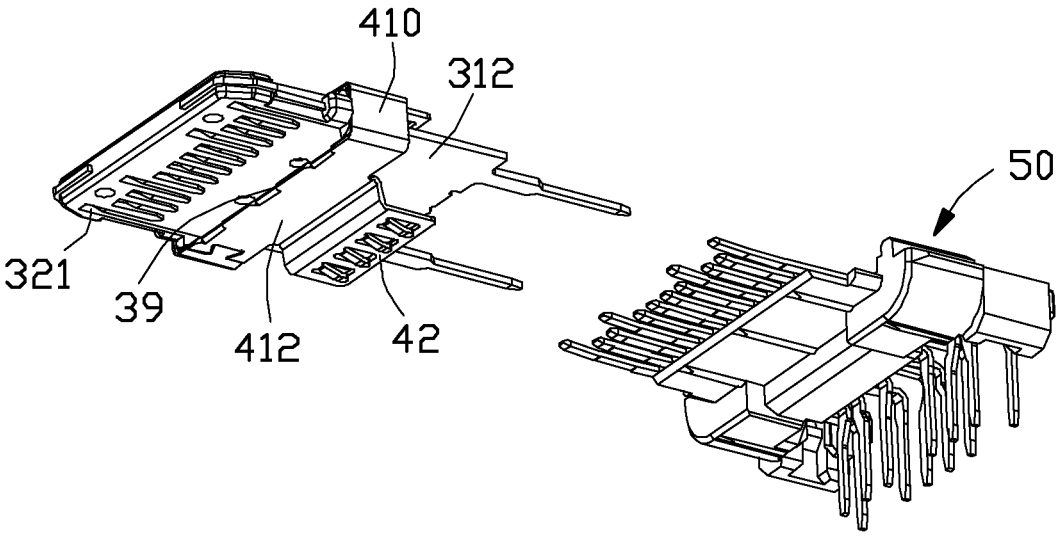
FIG. 6 is a partially exploded perspective view of the tongue plate and grounding collar, and the lower terminal module of the receptacle connector of FIG. 1.
Figure 7:
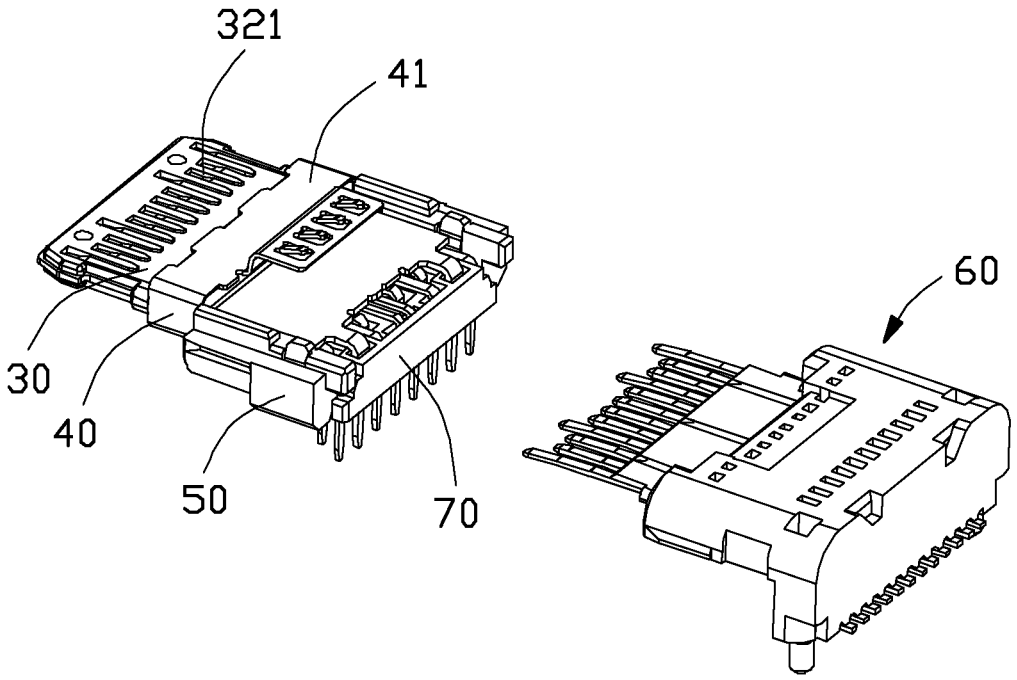
FIG. 7 is a partially exploded perspective view of the tongue plate, the grounding collar, the lower terminal module and the upper terminal module of the receptacle connector of FIG. 1.
Figure 8:
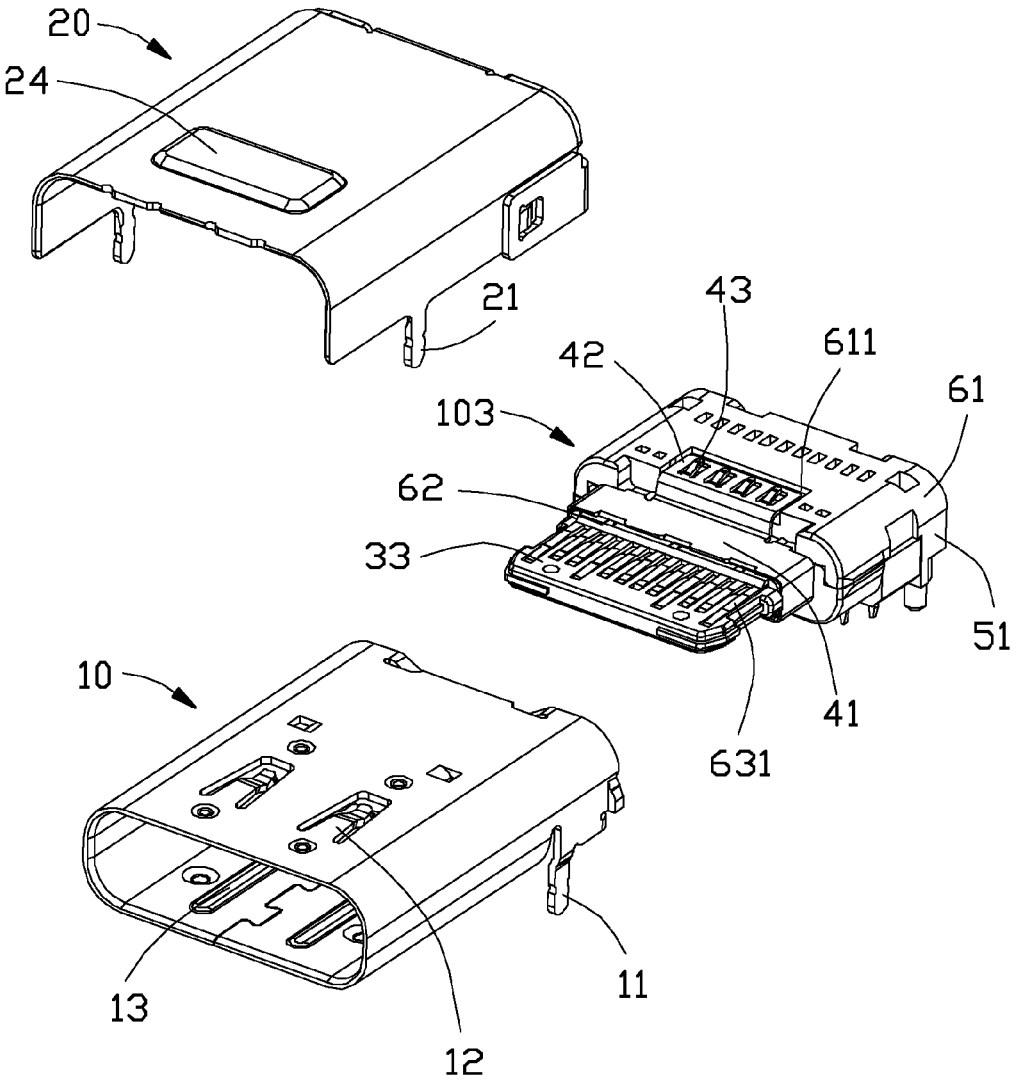
FIG. 8 is a partially exploded perspective view of the terminal module assembly, the shield and the bracket of the receptacle connector of FIG. 1.
Figure 9:
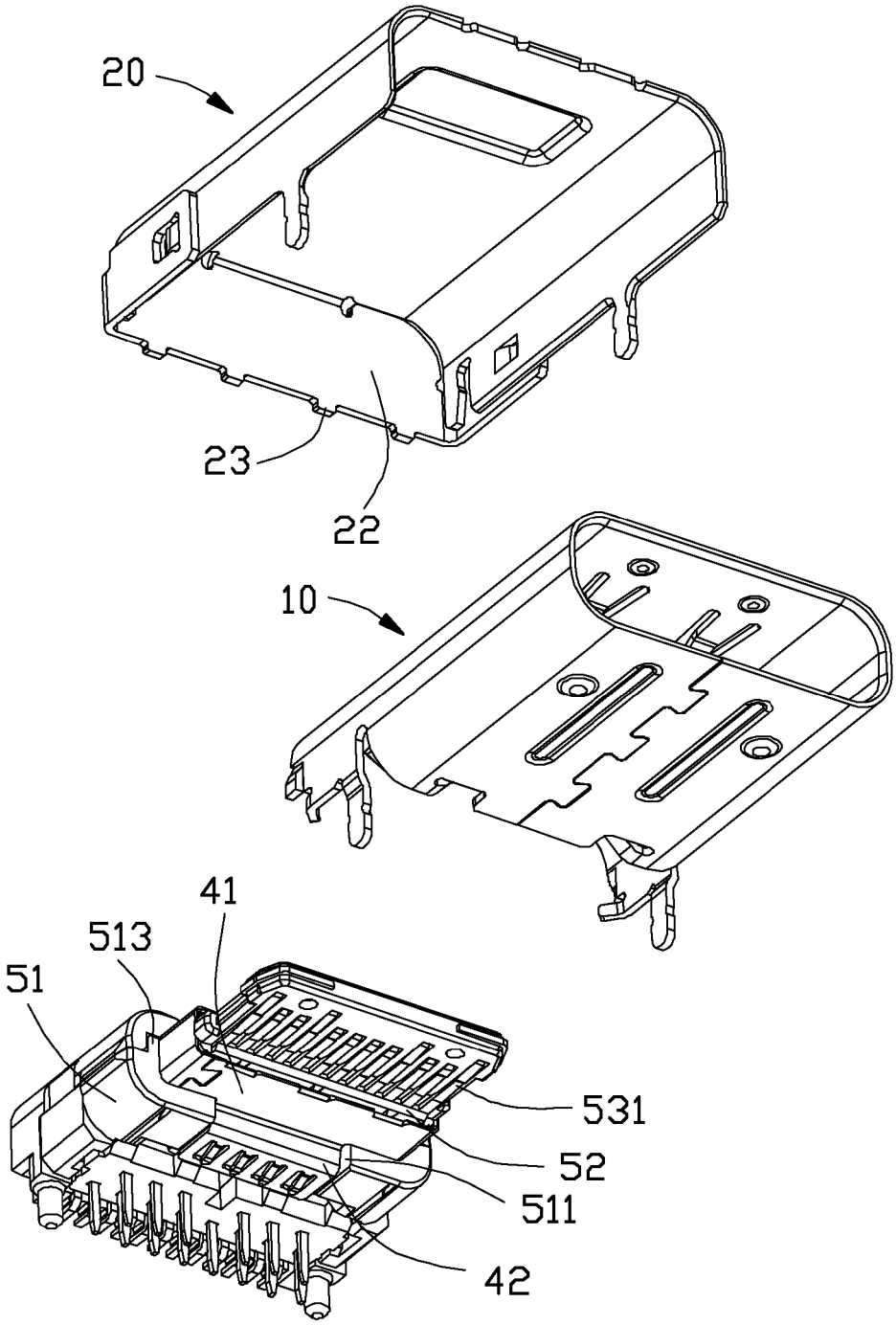
FIG. 9 is another partially exploded perspective view of the terminal module assembly, the shield and the bracket of the receptacle connector of FIG. 1.
Figure 10:
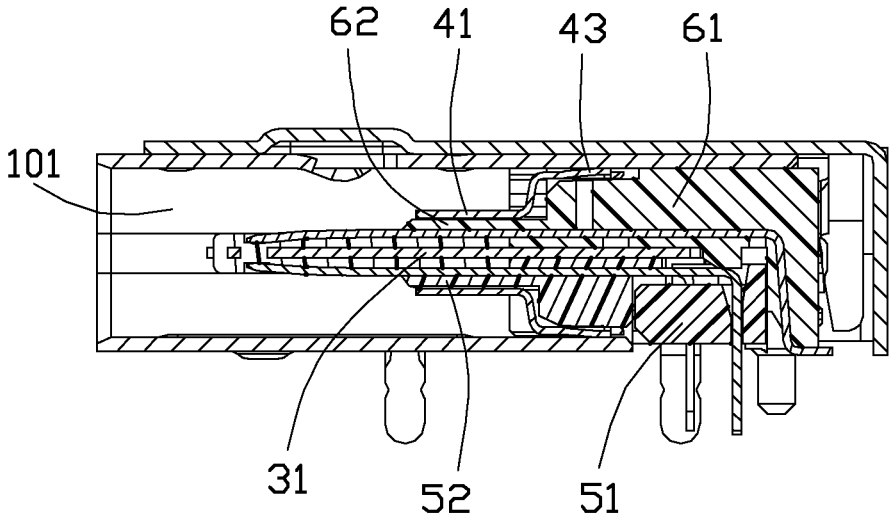
FIG. 10 is a cross-sectional view of the receptacle connector of FIG. 1.
Figure 11:
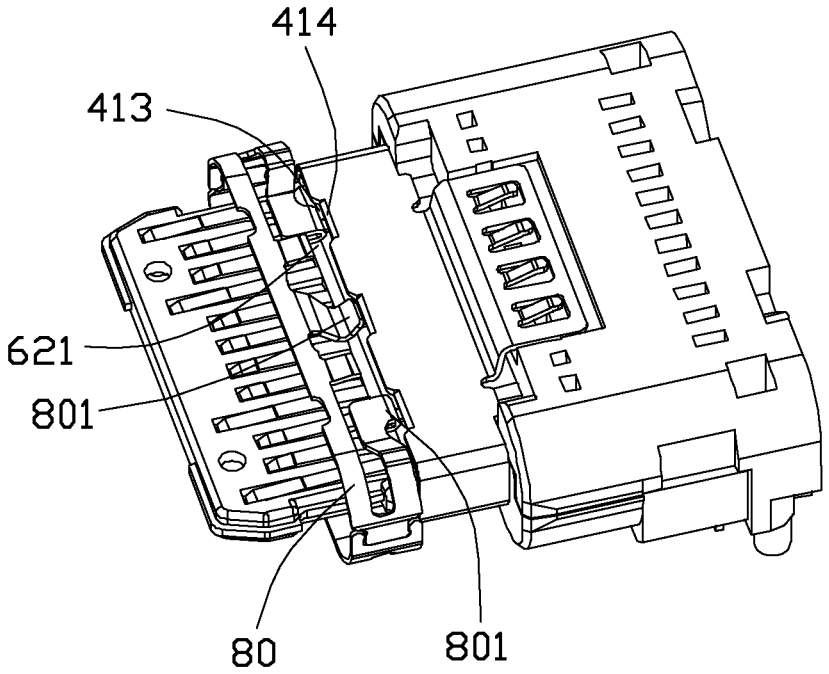
FIG. 11 is an illustrative view to show the spring finger of the interior grounding part of the mated plug connector and the receptacle connector of FIG. 1 in an initial mating stage.
Figure 12:
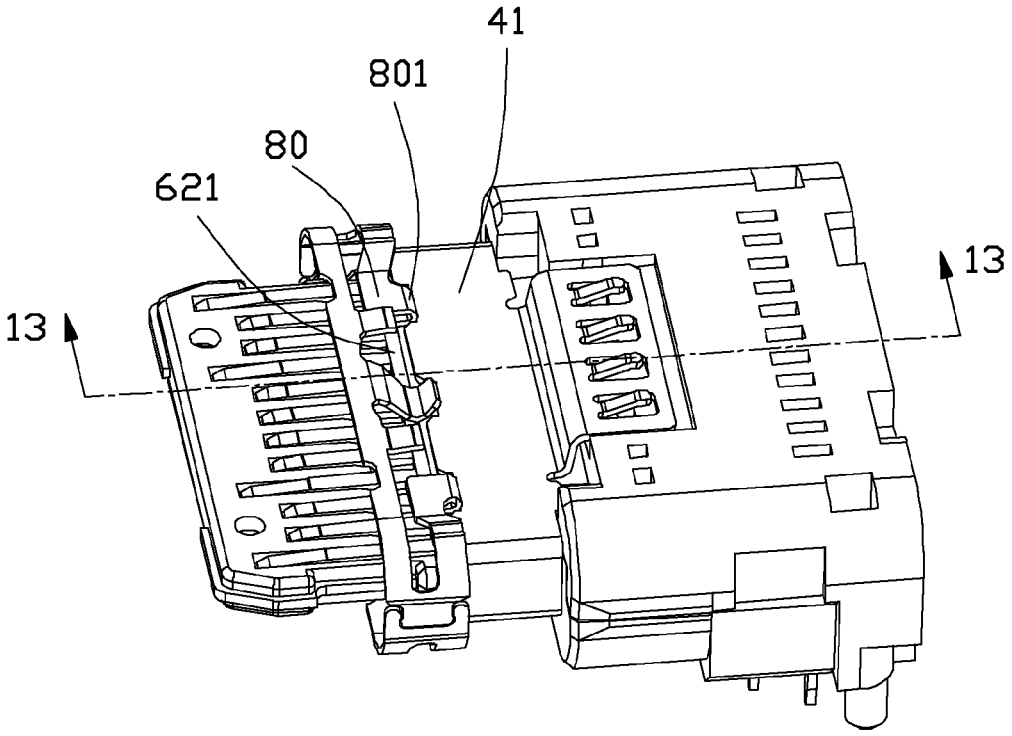
FIG. 12 is an other illustrative view to show the spring finger of the interior grounding part of the mated plug connector and the receptacle connector of FIG. 1 in a further inserted stage.
Figure 13:
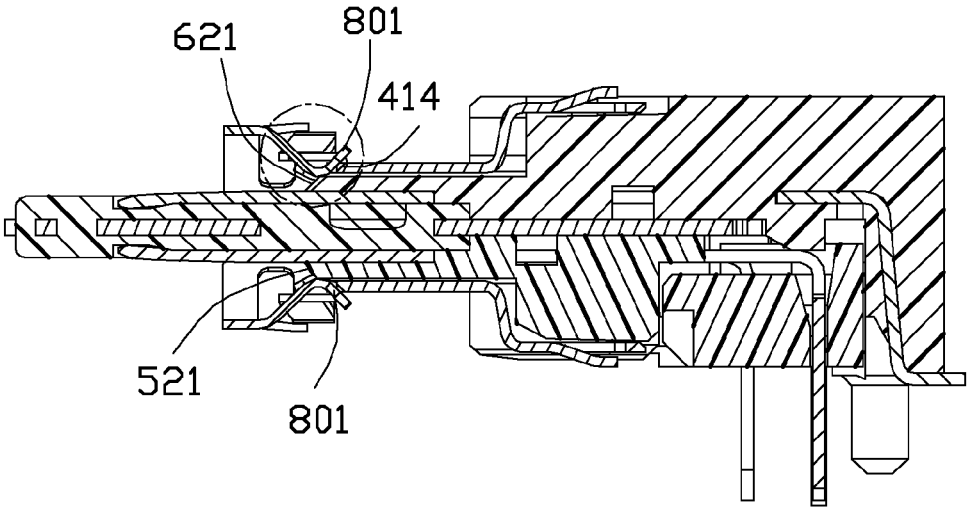
FIG. 13 is a cross-sectional view of the receptacle connector and the interior grounding part of the mated plug connector of FIG. 12.
Figure 14:
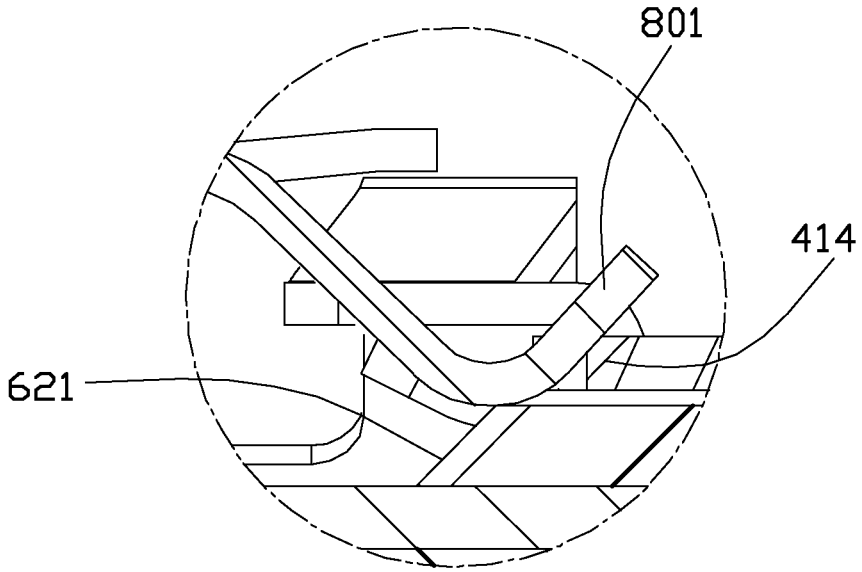
FIG. 14 is a partial enlarged cross-sectional view of the receptacle connector and the interior grounding part of the mated plug connector of FIG. 13.

Referring to FIGS. 1 to 2, an electrical receptacle connector 100 for mating with the plug connector (not completely shown while referring to FIGS. 36-39 of US2015/0171573 published Jun. 18, 2015) in a flippable manner. The receptacle connector 100 includes a metallic shield 10 forming a mating cavity 101 forwarding communicating with an exterior, and a tongue plate 30 extending in the mating cavity 101. In a front view, the cross-section of the mating cavity 101 likes an ellipse which is symmetrical in both the vertical direction and the transverse direction so as to allow the plug connector to be inserted thereinto in a flippable way. A metallic bracket 20 is attached upon the shield 10.

Referring to FIGS. 3-9, the connector 100 includes a terminal module assembly 103 and a grounding collar 40. The terminal module assembly 103 includes the tongue plate 30, the upper terminal module 60, the lower terminal module 50 and the spacer 70, a metallic shield plate 31 embedded within the tongue plate 30.

The shielding plate 31 is insert-molded within the tongue plate 30 which includes the insulator 32, and the front edge region 311 of the shielding plate 31 is embedded within the insulator 32 while the rear region 312 is exposed outside of the insulator 32. The front edge and two side edges of the front edge region 311 are exposed outside of the front edge and the side edge of the insulator 32, and the side edges of the insulator 32 forms notches 320 in which the side edge of the shielding plate 31 is exposed. Therefore, the shielding plate 31 functions not only to shield but also to retain with the plug connector. On the other hand, the exposed portions of the shielding plate 31 also provides strength thereof for protection during mating. The insulator 32 forms passageways 321 in two opposite surfaces and the shielding plate 31 is located between the corresponding passageways in the vertical direction. The insulator 32 forms a plurality of holes 322 behind the passageways 321 for use with insert-molding the shielding plate 31 in the insulator 32. The stoppers 323 are formed on two lateral sides of the insulator 32.

The grounding collar 4 includes a pair of horizontally extending grounding regions 41 and a pair of connection plates 42 extending from a rear edge of the grounding region 41. A pair of vertical walls 410 are connected between the pair of grounding regions 41 to form a frame structure. The connection plate 42 forms a plurality of spring tangs 43 arranged in one row along a transverse direction while each spring tang 43 extends in a front-to-back (A) direction. The grounding region 41 includes an upper grounding region 411 and a lower grounding region 412. The grounding collar 40 surrounds the root of the tongue plate 30 and abuts against the stoppers 323. The grounding collar 40 and the tongue plate 30 forms a gap 39 in the vertical direction. With regard to the stoppers 323, the tongue plate 30 includes a front portion 33 and a rear portion 34. Notably, the width of front portion 33 is larger than that of the rear portion 34 in a transverse (B) direction. The grounding collar 40 surrounds the rear portion 34, and the vertical walls 410 abut against two lateral sides of the rear portion 34 and forwardly abuts against rear sides of the corresponding stoppers 323. The upper grounding region 411 and the lower grounding region 412 are spaced from the tongue plate 30 with the gap 39, and the connection plate 42 are respectively located by two sides of the rear region 312 of the shielding plate 31.

The lower terminal module 50 includes a body portion 51, a step portion 52 in front of the body portion 51 and the lower contacts 53. The step portion 52 includes a leading face 521. The lower contact 53 includes the contacting section 531 extending beyond the step portion 52, and a leg 532 extending downwardly outside of the rear side of the body portion 51. The lower contact 53 further includes a middle portion (not labeled) embedded within the body portion 51 and the step portion 52. The lower terminal module 50 extends through the gap 39 and secured to the underside of the tongue plate 30. The contacting section 531 of the lower contact 53 is received within the corresponding passageway 321. The spacer 70 is assembled upwardly under the lower terminal module 50 for aligning the legs 532 of the lower contacts 53. The spacer 70 includes a pair of locking feet 71 each with a hook 711 for engagement within a slit 5112 formed in an undersurface of the body portion 51.

The upper terminal module 60, similar to the lower terminal module 50, includes a body portion 61, a step portion 62 in front of the body portion 61, and the contacts 63. The step portion 62 includes a lead face 621. The upper contact 63 includes a contacting section 63 extend beyond the step portion 62 and a leg 632 extending rearward outside of the body portion 61. The upper contact 63 further includes a middle portion (not labeled) embedded within the body portion 61 and the step portion 62. The upper terminal module 60 forwardly extends through the (upper) gap 39 formed between the grounding collar 40 and the tongue plate 30. The contacting section 631 of the upper contact 63 is received in the corresponding passageway 321.

The rear portion 34 of the tongue plate 30 forms the blocks 341 neighboring the front portion 33 and extending in the vertical direction. The step portion 52 of the lower terminal module 50 forms cutouts 521 to receive the corresponding blocks 341 for preventing excessive forward movement of the lower terminal module 50 with regard to the tongue plate 30. Similarly, the upper terminal module 60 has the similar blocks 621 for the same purpose. The lower terminal module 50 and the upper terminal module 60 form the ribs 513 and the grooves 613 to engage with each other so as to assure the correct positions between the lower terminal module 50 and the upper terminal module 60 when the upper terminal module 60 is forwardly inserted into the (upper) gap 39 of the sub-assembly of the tongue plate 30, the lower terminal module 50 and the grounding collar 40.

The upper terminal module 60 and the lower terminal module 50, the tongue plate 30 and the spacer 70 commonly define the terminal module assembly 103 wherein the step portions 62 and 52 are enclosed within the grounding collar 40. In brief, the terminal module assembly 103 includes the aforementioned front portion 33, and the rear body (including the body portions 51, 61), the middle step (including the step portions 62, 52) and the contacts (including the upper contacts 63 and the lower contacts 53). The shield 10 is fixed to the rear body to enclose the front portion 33 and the middle step to form the mating cavity 101. The grounding collar 40 includes the grounding regions 41 located upon the middle step, the front edges of the grounding regions being closer to the front edge of the middle step. Each grounding region 41 forms notches in a front edge to leave a space so as to allow the spring fingers of the grounding plate of the plug connector to slide on the rear step first before contacting the grounding region 41. The two connection plates 42 seated upon the rear body with the spring tangs 43 abutting pressing the shield 10. The connection plates 42 are received in the corresponding recessed areas 611, 511 of the body portion 61, 51. The shielding plate 31 is essentially sandwiched between the body portions 61, 51.

The shield 10 is mounted upon the terminal module assembly 103. The shield 10 is fixed to the body portions 61, 51 and surrounds the tongue plate 30 and the grounding collar 40 so as to form the mating cavity 101 therebetween. The shield 10 forms the spring leaves 12, the ribs 13 and the mounting legs 11. Notably, the spring tangs 43 may be replaced with the properly formed protrusions. The grounding region 41 is formed in a riveted way with a dovetailed structure.

The bracket 20 is soldered to the shield 10 and covers the top side, two lateral sides and the rear side of the shield 10 with the solder points 23 for securing. The bracket 20 forms recessions 24 to compensate movement of the spring leaves 12, and mounting legs 21.

During mating, the grounding plate 80 is inserted into the mating cavity 101 with spring fingers 801. In this embodiment, there are three on each side. Notably, the front edge of the grounding region 41 is essentially flush with the front edge of the middle step except at the three notches 413 which corresponds to the three spring fingers 801. A leading face 414 is formed on the notch 413. During mating, the spring finger 801 firstly contacts the step portion 62, 52 in the corresponding notch 413, and is successively raised up by the leading face 621, 521 so as to slide upon the step portion 62, 52 and further confronts the leading face 414 in the notch 413 and finally slide on the grounding region 41 to completely achieve the internal grounding path.

In brief, understandably, the front edge of the grounding region should be flush with the front edge of the step portions 62, 52 for assuring preferable shielding effect. Anyhow, such a flush arrangement may result in some collision the corresponding spring fingers of the plug connector during mating. In other words, without the notch 413, the spring finger 801 may improperly confront the front edge of the grounding region at an relatively inner position in the vertical direction so as to have a potential collision risk if the manufacturing tolerance is out of range. The provision of the notch 413 of the invention may forgive such condition advantageously while still maintaining the superior shielding effect by having the remaining portions of the grounding region flush with the step portion in the front edge.

What is claimed is:

1. A receptacle connector comprising:

a terminal module assembly enclosed within a metallic shield, said terminal module assembly including a front tongue plate extending, in a front-to-back direction, forwardly from a rear body, and contacting sections of upper and lower contacts being exposed upon two opposite upper and lower surfaces of the tongue plate in a vertical direction perpendicular to said front-to-back direction, and a step structure being formed at a rear root portion of the tongue plate, and a metallic grounding collar applied upon at least two opposite upper and lower faces of said step structure in the vertical direction, a front edge of said grounding collar being flush with a front edge of the step structure; wherein a plurality of notches are formed in a front edge region of said grounding collar so as to be rearwardly offset from the front edge of the step structure.

2. The receptacle connector as claimed in claim 1, wherein an inner edge of the notch forms a forward slant leading face.

3. The receptacle connector as claimed in claim 1, wherein the front edge of the step structure is formed with a forward tapered leading face.

4. The receptacle connector as claimed in claim 1, further including a shield plate extending in a horizontal plane defined by the front-to-back direction and a transverse direction perpendicular to both said front-to-back direction and said vertical direction, and embedded within the tongue plate in the vertical direction.

5. The receptacle connector as claimed in claim 4, wherein said terminal module assembly includes an upper terminal module with the upper contacts insert-molded therein, and a lower terminal module with the lower contacts insert-molded therein, to commonly sandwich the tongue plate therebetween in the vertical direction.

6. An electrical connector assembly comprising:

a receptacle connector and a plug connector adapted to be detachably mated with each other, said receptacle connector including:

a terminal module assembly including an insulative front tongue plate defining opposite upper and lower surfaces in the vertical direction, an insulative rear body located behind the tongue plate in a front-to-back direction perpendicular to said vertical direction, and dimensioned larger than the tongue plate in both the vertical direction and a transverse direction perpendicular to both said front-to-back direction and said vertical direction, and a middle step structure located in a boundary between the tongue plate and the body and dimensioned with a size between said tongue plate and the body in both said vertical direction and said body; and a metallic grounding collar applied upon at least two opposite upper and lower faces of the step structure;

said plug connector including a metallic spring plate having at least a spring finger deflectable in a vertical direction;

said grounding collar defining a grounding region defining a specific area corresponding to the spring finger during mating; wherein a confrontation edge of the grounding collar is rearwardly offset from a front edge of the step structure at said specific area in order to leave space for allowing the corresponding spring finger to slide on the step structure in the front-to-back direction for a distance before slide upon the grounding region, during mating.

7. The electrical connector assembly as claimed in claim 6, wherein said specific area is located in a notch in a front edge region of the grounding collar.

8. The electrical connector assembly as claimed in claim 6, wherein the confrontation edge is formed with a forward tapered leading face.

9. The electrical connector assembly as claimed in claim 6, wherein the front edge of the step structure is formed with a forwardly wedged leading face.

10. A method of coupling a receptacle connector and plug connector, comprising steps of:

providing the receptacle connector with a metallic shield enclosing a terminal module assembly, said terminal module assembly, said terminal module assembly including a front tongue plate extending, in a front-to-back direction, forwardly from a rear body, and contacting sections of upper and lower contacts being exposed upon two opposite upper and lower surfaces of the tongue plate in a vertical direction perpendicular to said front-to-back direction, and a step structure being formed at a rear root portion of the tongue plate, and a metallic grounding collar applied upon at least two opposite upper and lower faces of said step structure in the vertical direction, providing the plug connector with a metallic grounding plate with at least one spring finger; wherein during detachable mating, the spring finger firstly slides on the step structure in the front-to-back direction with a distance and successively slides on the grounding collar to complete an internal grounding path; wherein the grounding collar defines a confrontation edge in alignment with the spring finger in the front-to-back direction, and the spring finger firstly confronts a front edge of the step structure and successively confronts said confrontation edge in said front-to-back direction.

11. The method as claimed in claim 10, wherein the grounding collar forms a notch in a front edge region, and the confrontation edge is an inner edge in said notch.

12. The method as claimed in claim 11, wherein the confrontation edge forms a forward slant leading face.

13. The method as claimed in claim 12, wherein the front edge of the step structure forms a forward slant leading face.

* * * * *